US007140957B2

(12) United States Patent
Thysell et al.

(10) Patent No.: US 7,140,957 B2
(45) Date of Patent: Nov. 28, 2006

(54) ARRANGEMENT IN A MOBILE MACHINE FOR SCREEDING FLOOR SURFACES

(75) Inventors: Hakan Thysell, Soderkoping (SE); Karl Thysell, Soderkoping (SE); Urban Thysell, Ystad (SE)

(73) Assignee: HTC Sweden AB, Soderkoping (SE)

( * ) Notice: Subject to any disclaimer, the term of this patent is extended or adjusted under 35 U.S.C. 154(b) by 0 days.

(21) Appl. No.: 10/450,723

(22) PCT Filed: Jan. 25, 2002

(86) PCT No.: PCT/SE02/00124

§ 371 (c)(1),
(2), (4) Date: Nov. 21, 2003

(87) PCT Pub. No.: WO02/062524

PCT Pub. Date: Aug. 15, 2002

(65) Prior Publication Data

US 2004/0077300 A1 Apr. 22, 2004

(30) Foreign Application Priority Data

Feb. 6, 2001 (SE) ..... 0100416

(51) Int. Cl.
*B24B 7/18* (2006.01)

(52) U.S. Cl. ..... 451/350; 451/353; 451/359

(58) Field of Classification Search ..... 451/271, 451/350, 353, 359; 15/49.1
See application file for complete search history.

(56) References Cited

U.S. PATENT DOCUMENTS

| | | | | |
|---|---|---|---|---|
| 1,069,803 | A | 8/1913 | Nelson et al. | |
| 1,928,390 | A * | 9/1933 | Myers | 451/353 |
| 2,318,960 | A * | 5/1943 | Okun | 15/49.1 |
| 2,923,107 | A * | 2/1960 | Biasoni | 451/353 |
| 2,948,087 | A * | 8/1960 | Thomas | 451/271 |
| 3,169,262 | A * | 2/1965 | Allen et al. | 15/49.1 |
| 3,452,486 | A | 7/1969 | Lombardo et al. | |
| 4,049,950 | A | 9/1977 | Byrne et al. | |
| 4,097,950 | A * | 7/1978 | Satterfield | 15/49.1 |
| 4,319,434 | A * | 3/1982 | Brejcha | 451/353 |

(Continued)

FOREIGN PATENT DOCUMENTS

DE 196 49 282 C1 6/1998

(Continued)

*Primary Examiner*—M. Rachuba
(74) *Attorney, Agent, or Firm*—Merchant & Gould P.C.

(57) ABSTRACT

The invention relates to an arrangement in a mobile machine for screeding floor surfaces. This comprises a housing with a planet disk (3), which is rotatably supported in the bottom of the said housing and driven by a drive motor (1). The planet disk carries a number of rotatably supported screeding disks, distributed over the planet disk (3) and operatively connected to the drive motor (1). According to the invention the number of screeding disks is an even number up to a maximum of six. Viewed in the direction of rotation of the planet disk (3), half the number of screeding disks have a direction of rotation coinciding with the planet disk (3) and the remaining screeding disks an opposing direction of rotation.

10 Claims, 5 Drawing Sheets

U.S. PATENT DOCUMENTS

| | | | | |
|---|---|---|---|---|
| 4,709,510 | A * | 12/1987 | Giovanni et al. | 451/353 |
| 4,862,548 | A * | 9/1989 | Sergio | 15/49.1 |
| 5,070,656 | A * | 12/1991 | Brogden | 451/353 |
| 5,637,032 | A | 6/1997 | Thysell et al. | |
| 6,238,277 | B1 * | 5/2001 | Duncan et al. | 451/271 |
| 6,244,933 | B1 * | 6/2001 | Morkvenas | 451/10 |
| 6,308,360 | B1 * | 10/2001 | Stein | 15/98 |
| 6,331,138 | B1 * | 12/2001 | Witters et al. | 451/340 |
| 6,450,867 | B1 * | 9/2002 | Legatt | 451/350 |
| 6,494,773 | B1 * | 12/2002 | Marchini et al. | 451/353 |
| 6,540,596 | B1 * | 4/2003 | Van Der Veen | 451/350 |
| 6,752,707 | B1 * | 6/2004 | Palushi | 451/350 |
| 6,783,447 | B1 | 8/2004 | Van Vliet et al. | |
| 2004/0023608 | A1 * | 2/2004 | Van Vliet et al. | 451/350 |

FOREIGN PATENT DOCUMENTS

| | | |
|---|---|---|
| EP | 0 700 327 | 3/1996 |
| EP | 0 984 845 | 3/2000 |
| FR | 1.108.781 | 9/1955 |
| FR | 2.073.627 | 9/1971 |
| WO | 01/87540 | 11/2001 |

* cited by examiner

ARRANGEMENT IN A MOBILE MACHINE FOR SCREEDING FLOOR SURFACES

FIELD OF THE INVENTION

The present invention relates to an arrangement according to the pre-characterising clauses of claims 1 and 3.

BACKGROUND OF THE INVENTION

Reference is made to U.S. Pat. No. 5,637,032 A, U.S. Pat. No. 1,069,803 A, U.S. Pat. No. 4,097,950 A, FR 2073627 A5, FR 1108781 A as examples of the prior art.

Screeding machines of the aforementioned type function inherently well, but as the material in the screeding disks used to machine the floor surfaces is progressively developed, thereby enabling it to remove more floor material per unit time than before, there is a desire for more available power for machining of the floor material.

BRIEF SUMMARY OF THE INVENTION

The object of the present invention is to produce an arrangement in a screeding machine of the type referred to in the introductory part, which has an improved removal capability compared to known screeding machines. This is achieved in that the arrangement has the characteristic features specified in the characterising part of claims 1 and 3.

The arrangement according to the invention furthermore has one or more of the characteristic features specified in the subordinate claims.

The invention moreover affords the following advantages:

The screeding machine designed according to the invention has an improved balance and reduced lateral rotation, which especially in the case of a manually operated machine makes it easier to hold and control. More even screeding is achieved; with known machines it is easy to end up with a machining mark having a plate-shaped cross-section, which means that it is necessary to screed with a relatively large overlap, in order to obtain a plane finish.

BRIEF DESCRIPTION OF THE SEVERAL VIEWS OF THE DRAWINGS

The invention will be explained in more detail below with reference to the drawing attached, in which FIG. 1*a*, in an oblique, perspective view from beneath, shows by way of example a screeding unit in a screeding machine according to the invention, having a drive motor and a dished planet disk, which accommodates a belt transmission.

In FIGS. 1*a*, 1*b*, 1 denotes a drive motor mounted on a motor plate 2. The motor plate 2 is designed to be fitted in a screeding machine casing, not shown further, by means of a screw nut connection.

DETAILED DESCRIPTION OF THE INVENTION

Figure 1A:
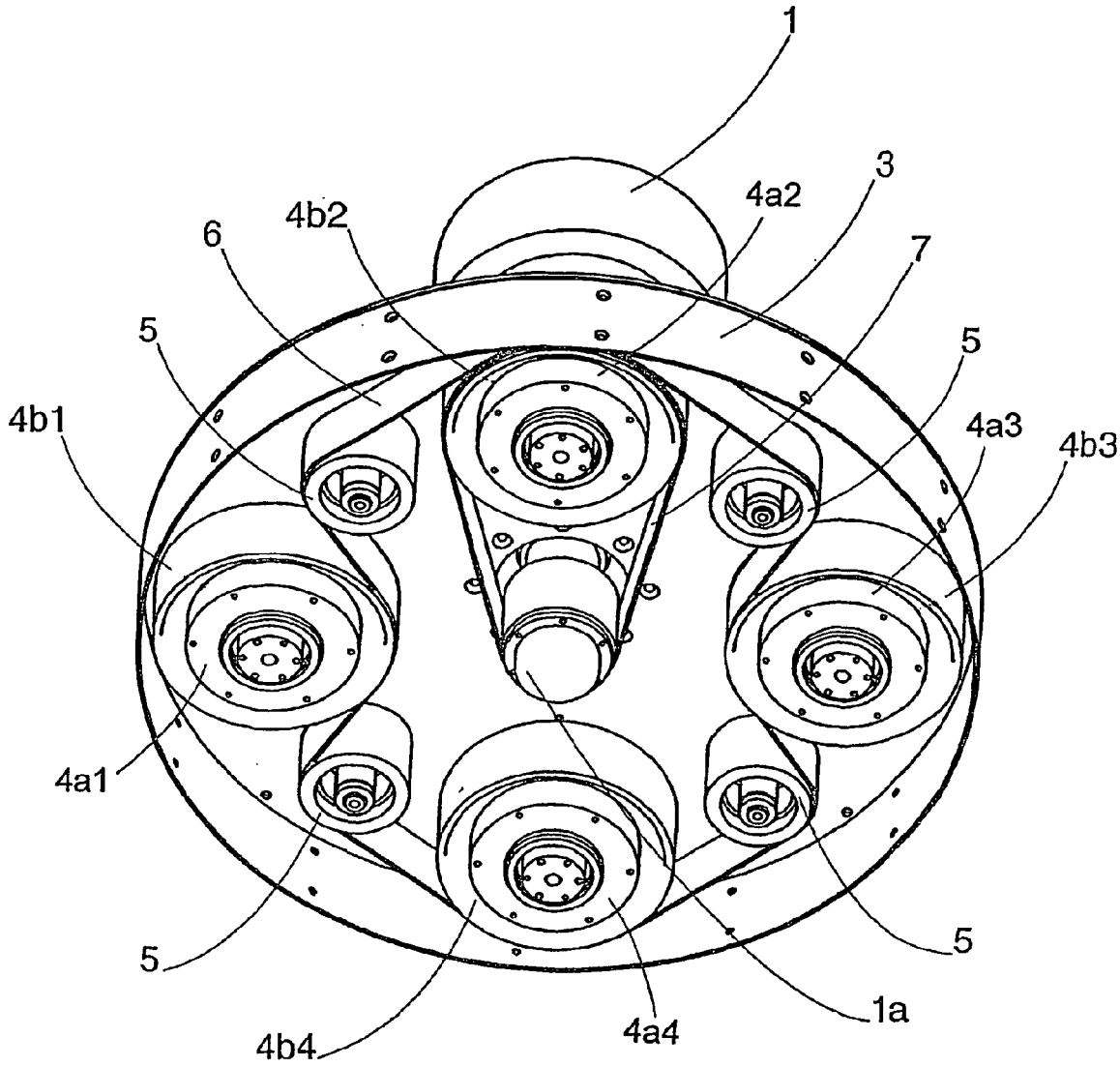

3 denotes a planet disk, which is supported so that it can rotate in relation to the motor plate 2 and is shaped like a dish open at the bottom. When the screeding unit is ready for use the dish is covered by a protective plate having openings for the screeding disks. The dish with the protective plate forms a protected space for the drive mechanism, as will be explained below. This space accommodates four symmetrically located holders 4*a*1–4*a*4 for screeding disks 4*c*1–4*c*4, the holders being supported so that they can rotate, in the planet disk 3. For the sake of clarity, the screeding disks have been omitted from FIG. 1*a* but are shown in FIG. 1*c*, in which the directions of rotation, according to the invention, of the screeding disks 4*c*1–4*c*4 and the planet disk 3 are also illustrated by arrows 3*p* and 4*p* respectively. 3*a* denotes a plate having openings for the screeding disks 4*c*1–4*c*4, designed to protect the belt transmissions in the dished planet disk 3. A belt sheave 4*b*1–4*b*4 is connected to each holder 4*a*1–4*a*4 for driving each screeding disk in the manner characteristic of the invention. A belt 6 runs over the belt sheaves 4*b*1–4*b*4 and over deflection sheaves 5 arranged between them. A belt sheave 1*a* arranged on the shaft of the motor 1 is designed to drive the belt sheave 4*b*2 by way of a belt 7, thereby causing the other belt sheaves to rotate. Since the belt 6 runs over that section of the circumference situated nearest to the centre of the planet disk 3 in respect of the belt sheaves 4*b*1 and 4*b*3 and over the section of the circumference situated furthest away from the said centre in respect of the belt sheaves 4*b*2 and 4*b*4, the belt sheaves 4*b*1, 4*b*3 assume opposing directions of rotation relative to the belt sheaves 4*b*2, 4*b*4, thereby providing the characteristic feature of the present invention, namely that adjacent screeding disks have opposite directions of rotation.

Figure 1B:
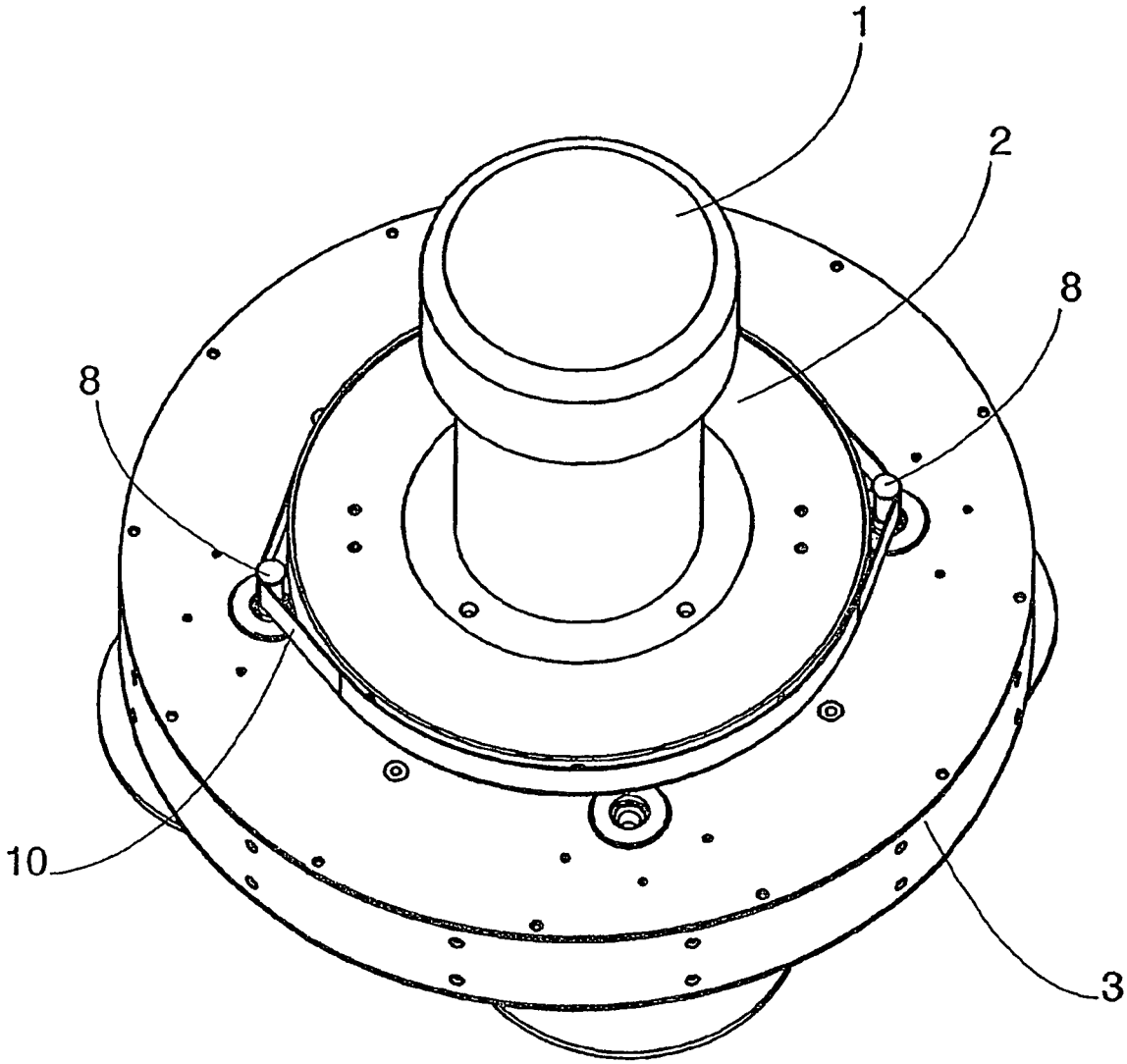
FIG. 1*b* shows the drive motor and the planet disk in FIG. 1*a* in an oblique perspective view from above.
Figure 1C:
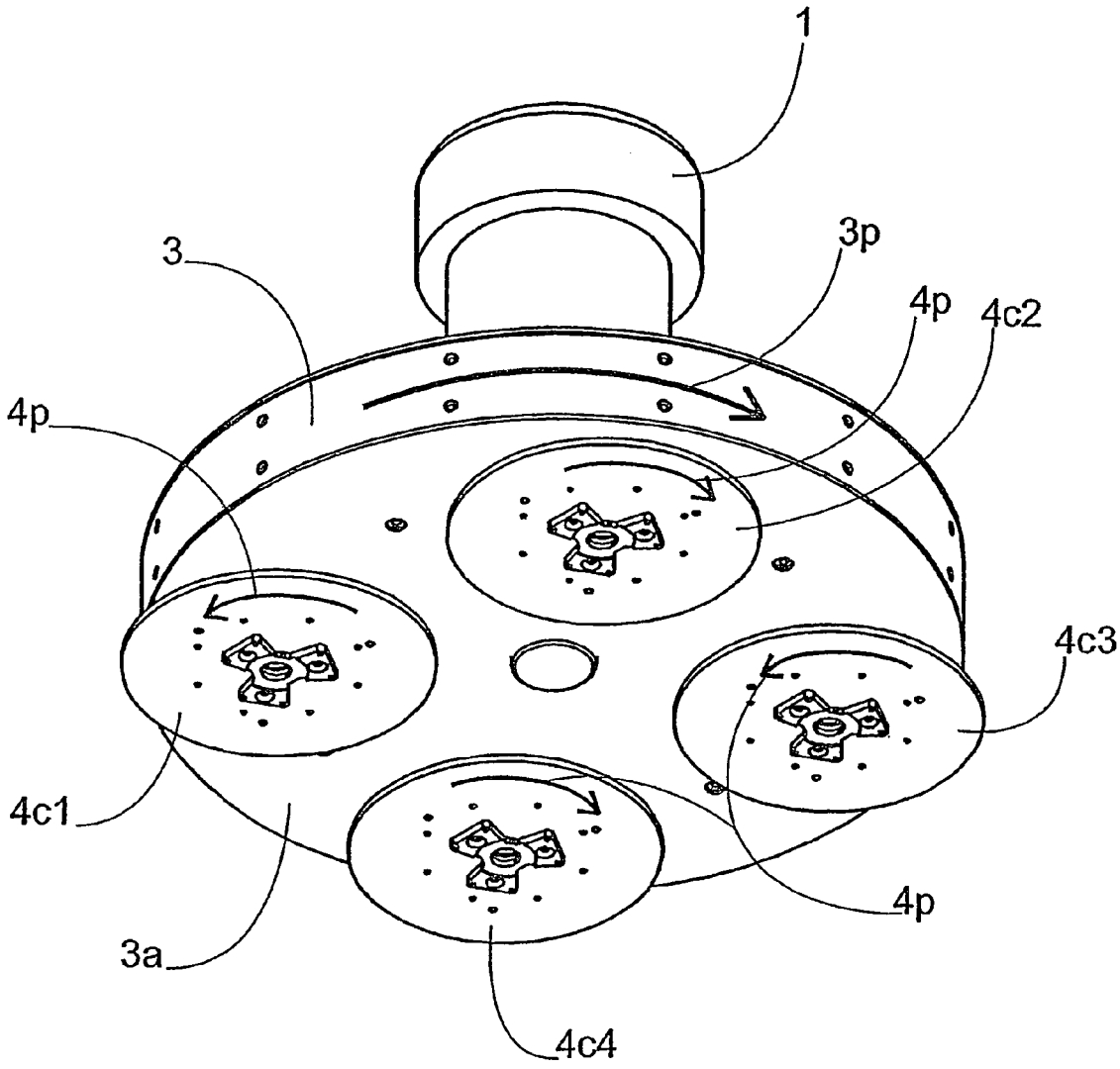
FIG. 1*c* shows essentially the same view as FIG. 1*a*, but the planet disk and the belt transmission are covered by a cover plate with openings for the machine's screeding disks.
Figure 2:
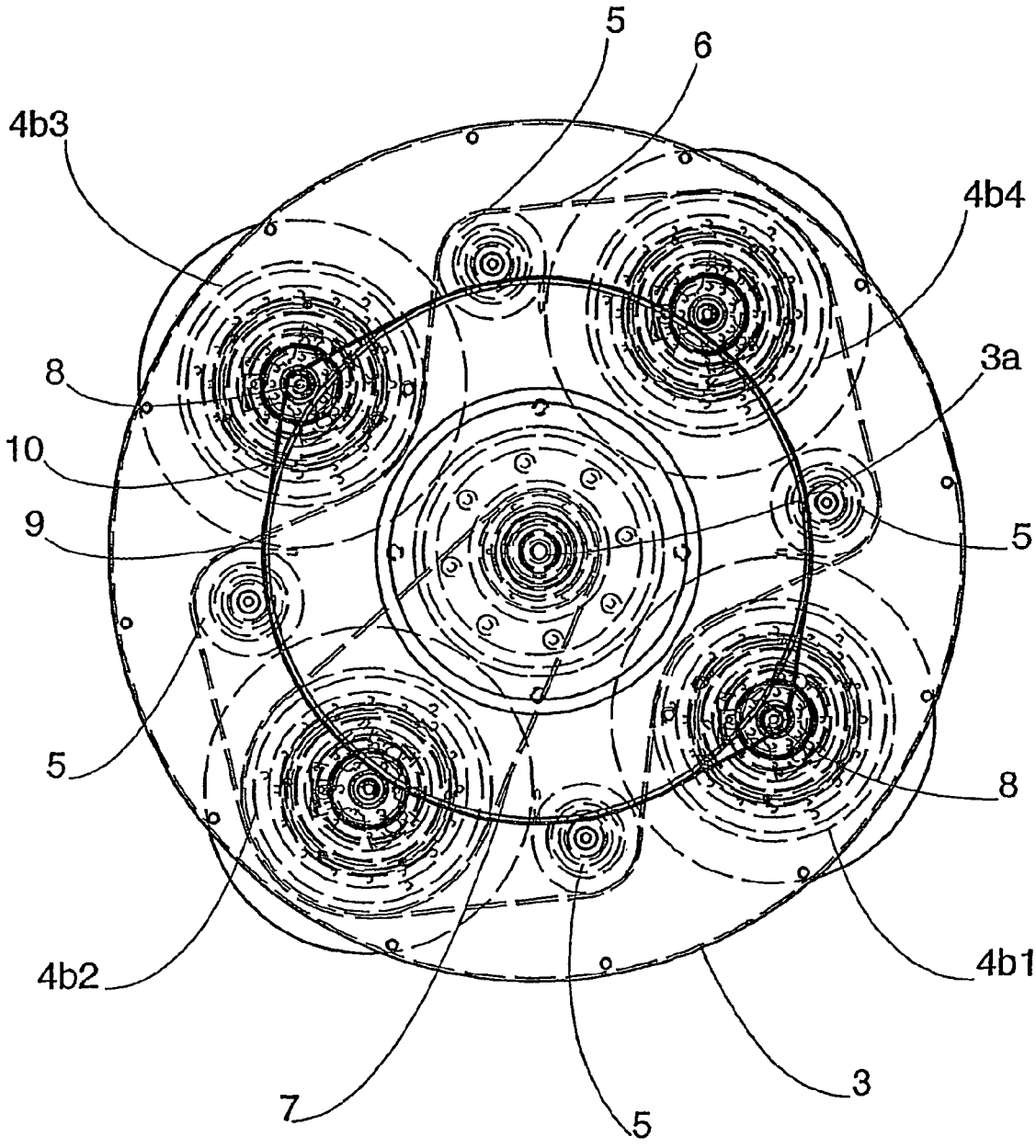
FIG. 2, by way of an example, shows a plan view of a system of belts for driving the screeding machine planet disk and screeding disks of the type used in the embodiment according to FIGS. 1*a*, 1*b*.
Figure 3:
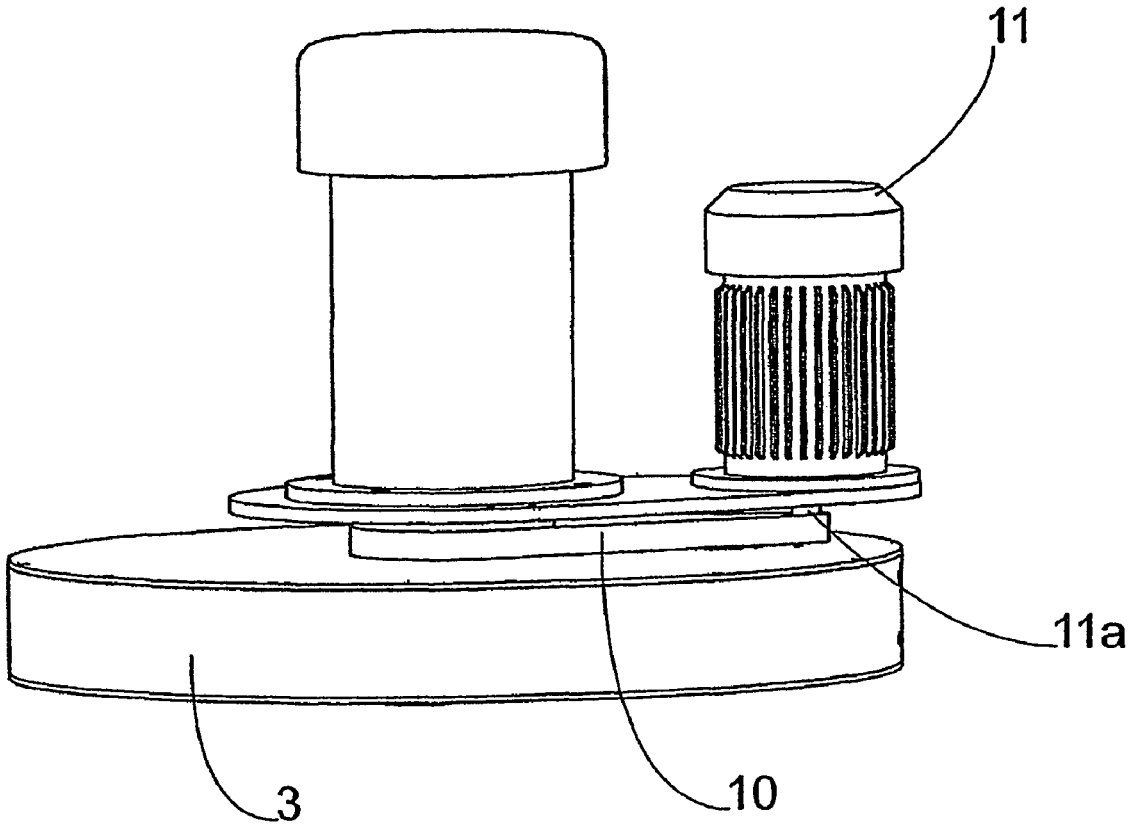
FIG. 3 in a side view illustrates an embodiment of a screeding unit according to the invention, in which the screeding unit planet disk is driven by a separate drive motor.

From FIG. 1*b*it can be seen that shafts of the belt sheaves 4*b*1, 4*b*3 protrude from the dished planet disk 3 and form belt sheaves 8. 9 denotes a belt sheave fixed to the motor plate 2. A belt 10, by means of which the rotation of the motor 1 is transmitted to the planet disk 3 by way of the belt sheave 1*a*, the belt 7, the belt sheave 4*a*2, the belt 6 and the belt sheaves 4*b*1, 4*b*3, runs over the belt sheaves 8 and 9. It may be noted in this connection that the planet sheave 3 has the same direction of rotation as the screeding disks 4*c*2, 4*c*4. From this it follows that these screeding disks in an area furthest away from the centre of the planet disk 3 have a higher peripheral speed in relation to a surface that is to be screeded than do the screeding disks 4*c*1, 4*c*3 in the same area. If so required, this can, as the person skilled in the art will appreciate, be compensated for by giving the belt sheaves 4*b*1, 4*b*3 and 4*b*2, 4*b*4 correspondingly different diameters. For the sake of clarity all belts and belt sheaves are drawn in FIG. 2.

The person skilled in the art will also appreciate that some or all of the belt transmissions may be replaced by gear transmissions or transmissions having a frictional engagement.

It will also be appreciated that, without departing from the idea of the invention, six screeding disks supported by holders may be arranged on the planet wheel 3, each holder being connected to s belt sheave. A belt runs over the belt sheaves and over intermediate deflection sheaves in the manner already explained, which means that adjacent screeding disks have opposite directions of rotation. At the same time the planet disk carrying the screeding disks is driven in the same way as explained earlier. In this embodiment also, the belt transmissions can be replaced wholly or in part by gear transmissions or transmissions having a frictional engagement.

In a particular embodiment of the arrangement according to the invention, the planet disk 3 is driven by its own motor 11. The belt 10, which in the embodiment according to FIGS. 1*a*, 1*b* runs over belt sheaves 8, then runs instead over the belt sheave 11*a* of the motor 11. Separate driving of the planet disk 3 affords two advantages: firstly it is possibly to freely select the direction of rotation of the planet disk 3 and secondly the speed of rotation can be selected irrespective of the speed of the screeding disks, in order obtain the optimum screeding result. A gear transmission can obviously also be used in this embodiment instead of the belt transmission.

Although the invention above has been primarily illustrated and explained in connection with a screeding unit for a manually operated screeding machine, it will be obvious that the screeding unit according to the invention affords the same advantages when it is fitted to a powered screeding machine. It is also advantageous here that lateral forces occurring are minimised and that the effective screeding profile of the screeding unit permits screeding with little overlap.

The invention claimed is:

1. An arrangement in a mobile machine for screeding floor surfaces comprising:

a housing with a planet disk rotatably supported in the bottom of the housing and driven by a drive motor, and which carries an even number of up to six but not less than four screeding disks, operatively connected to the drive motor and defining one screeding plane, wherein the operative connection comprises:

belt sheaves, wherein a belt sheave is associated with each of the screeding disks, deflection sheaves arranged between the belt sheaves, a first belt arranged such that the first belt bears against a part of the circumferences of the belt sheaves and against a part of the circumferences of the deflection sheaves, wherein the first belt alternates from belt sheave to belt sheave and lies alternately closest to the center of the planet disk and furthest away from the center of the planet disk and wherein the first belt lies furthest from the center when bearing against the deflection sheaves, and a second belt running between a belt sheave arranged on the shaft of the motor and one of the belt sheaves belonging to the screeding disks.

2. An arrangement in a mobile machine for screeding floor surfaces comprising:

a housing with a planet disk rotatably supported in the bottom of the housing and driven by a drive motor, and which carries an even number of up to six but not less than four screeding disks, operatively connected to the drive motor and defining one screeding plane, wherein the operative connection comprises:

belt sheaves, wherein a belt sheave is associated with each of the screeding disks, deflection sheaves arranged between the belt sheaves, a first belt arranged such that the first belt bears against a part of the circumferences of the belt sheaves and against a part of the circumferences of the deflection sheaves, wherein the first belt alternates from belt sheave to belt sheave and lies alternately closest to the center of the planet disk and furthest away from the center of the planet disk and wherein the first belt lies furthest from the center when bearing against the deflection sheaves, and a second belt running between a belt sheave arranged on the shaft of the motor and one of the belt sheaves belonging to the screeding disks, wherein the screeding disks that have a direction of rotation opposed to the planet disk have a rotational speed, which is so much greater than the rotational speed of the screeding disks that have the same direction of rotation as the planet disk, and that at the periphery of the planet disk all screeding disks have approximately the same peripheral speed in relation to the surface that is to be screeded.

3. An arrangement in a mobile machine for screeding floor surfaces comprising:

a housing with a planet disk, which is rotatably supported in the bottom of the housing and which carries a number of rotatably supported screeding disks, distributed over said planet disk and operatively connected to a drive motor, and defining one screeding plane, wherein the planet disk is operatively connected to a second drive motor, intended solely for driving the planet disk, and wherein the number of screeding disks constitutes an even number up to a maximum of six, half the number of screeding disks have a direction of rotation coinciding with the planet disk and the remaining screeding disks an opposing direction of rotation.

4. An arrangement according to claim 3, wherein the operative connection between the planet disk and its drive motor comprises a belt or gear transmission.

5. A mobile machine for screeding floor surfaces comprising:

a housing with a planet disk rotatably supported in the bottom of the housing and carrying a number of rotatably supported screeding disks, distributed over said planet disk and operatively connected to a drive motor fixedly connected to a motor plate, and defining one screeding plane, wherein the number of screeding disks constitutes an even number up to a maximum of six, half the number of screeding disks have a direction of rotation coinciding with the planet disk and the remaining screeding disks an opposing direction of rotation, and a transmission arranged to connect two of said screeding disks having the same direction of rotation to the motor plate, such that rotation of said two screeding discs is transmitted to the motor plate, to rotate the planet disk relative to the motor plate and, wherein the transmission comprises respective first and second belt sheaves connected to a respective one of said screeding disks having the same direction of rotation, a third belt sheave mounted to the motor plate and a belt arranged between and in contact with said first, second and third belt sheaves.

6. The mobile machine for screeding floor surfaces as claimed in claim 5, wherein said planet disk comprises a hollow disk-shaped body, which when in use is arranged substantially in parallel with the floor surface.

7. The mobile machine for screeding floor surfaces as claimed in claim 6, wherein said screeding disks are arranged on a lower side of the planet disk, and wherein the first and second belt sheaves are arranged on an upper side of the planet disk.

8. The mobile machine for screeding floor surfaces as claimed in claim 7, wherein said first and second belt sheaves are arranged on a respective shaft of a respective one of said screeding disks.

9. The mobile machine for screeding floor surfaces as claimed in claim 8, wherein said shafts protrude through the planet disk to the upper side of the planet disk.

10. The mobile machine for screeding floor surfaces as claimed in claim 5, wherein said two screeding disks having the same direction of rotation are arranged on opposite sides of the motor plate.

* * * * *